US007218889B2

(12) United States Patent
Yamada et al.

(10) Patent No.: US 7,218,889 B2
(45) Date of Patent: May 15, 2007

(54) IMAGE FORMING APPARATUS

(75) Inventors: Masakatsu Yamada, Ibaraki (JP); Toshiyuki Takano, Ibaraki (JP); Yasuhiro Matsumoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/180,532

(22) Filed: Jul. 14, 2005

(65) Prior Publication Data

US 2005/0254869 A1 Nov. 17, 2005

Related U.S. Application Data

(62) Division of application No. 10/667,418, filed on Sep. 23, 2003, now Pat. No. 6,954,610.

(30) Foreign Application Priority Data

Oct. 15, 2002 (JP) ..... 2002-301148
Oct. 15, 2002 (JP) ..... 2002-301149

(51) Int. Cl.
*G03G 21/00* (2006.01)
*G03G 15/00* (2006.01)

(52) U.S. Cl. ..... 399/361; 399/81; 399/405

(58) Field of Classification Search ..... 358/474, 358/498; 399/81, 107, 361, 362, 366, 405
See application file for complete search history.

(56) References Cited

U.S. PATENT DOCUMENTS

| | | | | |
|---|---|---|---|---|
| 4,802,229 | A | 1/1989 | Yamada | 382/1 |
| 6,057,936 | A * | 5/2000 | Obara et al. | 358/296 |
| 6,147,778 | A | 11/2000 | Yamada et al. | 358/474 |
| 6,208,828 | B1 | 3/2001 | Awai et al. | |
| 2003/0048466 | A1 | 3/2003 | Yamada et al. | 358/1.12 |

FOREIGN PATENT DOCUMENTS

| | | |
|---|---|---|
| JP | 8-339106 | 12/1996 |
| JP | 2000-295411 | 10/2000 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus including: an image recording portion that records an image on a sheet; a sheet stacking portion which is provided above the image recording portion and on which the sheet delivered from the image recording portion is stacked; and an image reading portion that is provided above the sheet stacking portion and reads an image on an original, the image reading portion being disposed on a rear side so that the sheet delivered from the image recording portion onto the sheet stacking portion is partially exposed to the outside on a front side of the image reading portion.

8 Claims, 13 Drawing Sheets

IMAGE FORMING APPARATUS

This application is a division of U.S. application Ser. No. 10/667,418 filed Sep. 23, 2003, now U.S. Pat. No. 6,954,610, the entire content of which is incorporated herein by reference.

BACKGROUND OF THE INVENTION

1. Field of the Invention

The present invention relates to an image forming apparatus including an image reading portion that reads image information from a recording body, such as an original or an opened book, and an image recording portion that records an image on a sheet.

2. Related Background Art

Various image forming apparatuses have conventionally been used, examples of which include a copying machine, a facsimile, a printer, and a composite machine integrating functions of these apparatuses. Also, in general, many image forming apparatuses have a construction in which an image reading portion having an original stand that can be upwardly opened is disposed in an upper portion of an apparatus main body to thereby improve user's operability in placing an original and an image recording portion is disposed in a lower portion of the apparatus main body.

Also, many old-type image forming apparatuses adopt a construction in which a sheet on which an image has been formed in an image recording portion is delivered onto a tray provided on a side surface of an apparatus main body. If the tray protrudes from the side surface, however, the installation space for the apparatus main body needs to be increased by an area corresponding to the projection area of the tray. In view of this problem, image forming apparatuses with reduced installation spaces have come into general use. Such image forming apparatuses have a construction in which an image reading portion is disposed above an image recording portion, and a sheet on which an image has been formed is delivered into a space between the image recording portion and the image reading portion, thereby preventing protrusion of the sheet to the outside from a side of an apparatus main body. Also, image forming apparatuses have been developed which have a construction which enables improvement in ease of taking a sheet out, visibility of the sheet, and the like as well as miniaturization of the apparatus. Examples of such image forming apparatuses will be described below.

An image forming apparatus 101 of a first conventional example shown in FIG. 12 is an image forming apparatus disclosed in Japanese Patent Application Laid-Open No. 08-339106. This image forming apparatus 101 includes an image recording portion 112 and an image reading portion 114, with the image recording portion 112 delivering a sheet on which an image has been formed, to a delivery tray 111 provided above the image recording portion 112 and the image reading portion 114 being disposed above the delivery tray 111 and being held by a supporting member 113. Also, in the image forming apparatus 101, a center position SC of the image reading portion 114 is displaced backward relative to a sheet delivery center position HC of the image recording portion 112. With this construction, an operation portion 115 is prevented from protruding to the outside on the front side (right side in the drawing) and thus visibility of the sheet delivered onto the delivery tray 111 and ease of taking out of the delivered sheet are improved.

An image forming apparatus 102 of a second conventional example shown in FIG. 13 is an image forming apparatus disclosed in Japanese Patent Application Laid-Open No. 2000-295411. This image forming apparatus 102 includes an image recording portion 122 and an image reading portion 124. The image recording portion 122 delivers a sheet on which an image has been formed, onto a delivery tray 121 provided above the image recording portion 122 and the image reading portion 124 is disposed above the delivery tray 121. In this image forming apparatus 102, the lower surface of the image reading portion 124 on the front side is situated at a height higher than the rear-side height thereof. With this construction, the sheet taking-out space B is enlarged on the front side and ease of taking out of a sheet is thus realized without increasing the height of the image reading portion 124 more than necessary. Also, provided on the front side of the image reading portion 124 is an operation portion 125 with which the whole of the image forming apparatus 102 is operated.

In the case of the image forming apparatus 101 of the first conventional example, however, in order to improve visibility of the delivered sheet, a sheet delivery space A between the image recording portion 112 and the image reading portion 114 and between the image recording portion 112 and the operation portion 115 is required to have a height which allows the sheet to be taken out therefrom. Consequently, the heights of the image reading portion 114 and the operation portion 115 are increased, which leads to a problem that ease of setting of an original and ease of input of commands using the operation portion 115 are impaired. Also, the supporting member 113 provided below the operation portion 115 becomes an obstacle when a user takes the sheet out, which means that it is difficult for the user to take the sheet out. Further, there is a danger that the sheet may contact the supporting member 113 and be damaged.

Like in the first conventional example, in the case of the image forming apparatus 102 of the second conventional example, in order to improve visibility of the delivered sheet, the sheet delivery space B between the image recording portion 122 and the image reading portion 124 and between the image recording portion 122 and the operation portion 125 is required to have a considerable height and therefore the positions of the image reading portion 124 and the operation portion 125 are raised, which results in a problem that it becomes difficult to set an original and to input commands using the operation portion 125.

Also, the image forming apparatuses of the first and second conventional examples do not address the following points: the construction for electrically connecting a command input circuit board, which is required in association with the operation portion, to a main body control circuit board; the construction in which a consideration is given to electric noise with respect to the arrangement and connection of the circuit boards; the arrangement and construction of motors for driving the image reading portion and the image recording portion and a fan motor for cooling the image recording portion; the construction for preventing the adverse effect of the electric noise generated from these motors on the circuit boards, and the like.

SUMMARY OF THE INVENTION

The present invention has been made in order to solve the aforementioned problems of the conventional techniques, and therefore a first object of the invention is to provide an image forming apparatus in which ease of setting a sheet in an image reading portion, ease of taking a sheet out of an image recording portion, and operability in inputting operation information into the apparatus are improved by reducing the height of the apparatus itself without increasing its installation space.

Further, a second object of the present invention is to provide an image forming apparatus in which the influence of electric noise, which is generated by various motors provided inside the image forming apparatus, on circuit boards provided inside the image forming apparatus is minimized and the level of noise perceived by a user is lowered.

In order to attain the above-mentioned first object, according to the present invention, there is provided an image forming apparatus including: an image recording portion that records an image on a sheet; a sheet stacking portion which is provided above the image recording portion and on which the sheet delivered from the image recording portion is stacked; and an image reading portion that is provided above the sheet stacking portion and reads an image on an original, the image reading portion being disposed on a rear side so that the sheet delivered from the image recording portion onto the sheet stacking portion is partially exposed to the outside on a front side of the image reading portion.

In order to attain the above-mentioned second object, according to the present invention, there is provided an image forming apparatus including: an image recording portion that records an image on a sheet; a sheet stacking portion which is provided above the image recording portion and on which the sheet delivered from the image recording portion is stacked; an image reading portion that is provided above the sheet stacking portion and reads an image on an original; an operation portion for performing operations on the image recording portion and the image reading portion, which is provided on a front side of the image reading portion and on an upstream side with respect to a direction in which the sheet is delivered to the sheet stacking portion; a first circuit board disposed inside the image forming apparatus and below the operation portion; a second circuit board disposed on a front side inside the image forming apparatus, and below the operation portion; and a first connecting member that is provided on the front side inside the image forming apparatus and electrically connects the first circuit board to the second circuit board.

Other objects and features of the present invention will become apparent from the following description of the specification made with reference to the accompanying drawings.

DETAILED DESCRIPTION OF THE PREFERRED EMBODIMENTS

An image forming apparatus according to an embodiment of the present invention will now be described with reference to the accompanying drawings.

It should be noted here that there are various image forming apparatuses such as a copying machine, a printer, a facsimile, and a composite machine integrating functions of these apparatuses. In this embodiment, a digital copying machine will be described as an example, although the present invention is not limited to the digital copying machine.

Also, in this embodiment, a sheet bearing an image to be copied is referred to as the original and is given a reference symbol D, while a sheet on which the image is copied is referred to as the recording paper and is given a reference symbol P.

While the copying machine of this embodiment is also capable of reading an image on an opened book in addition to an original, a case where an original is read will be described below. The original, book, and the like are collectively referred to as the recording body in this specification.

Figure 1:
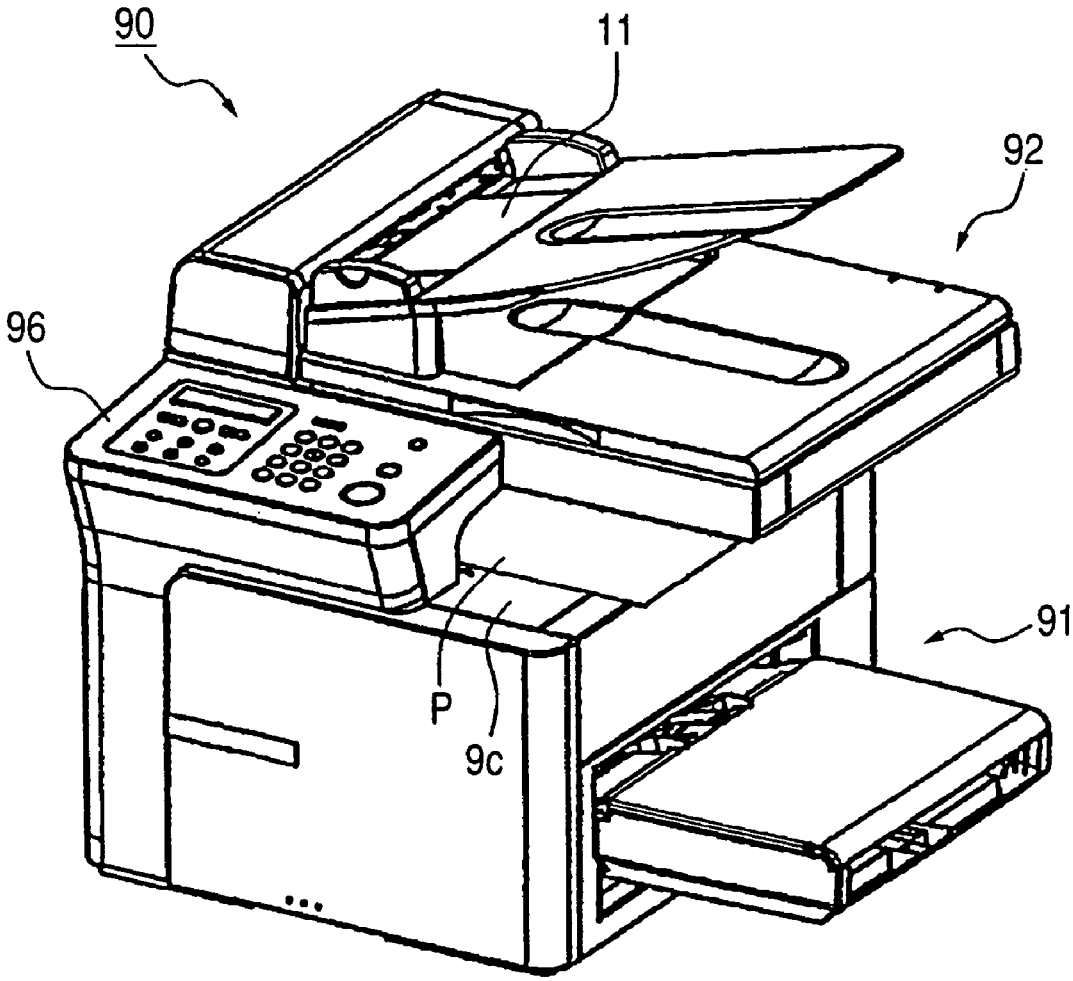
FIG. 1 is an external perspective view of a digital copying machine that is an example of an image forming apparatus according to an embodiment of the present invention.
Figure 2:
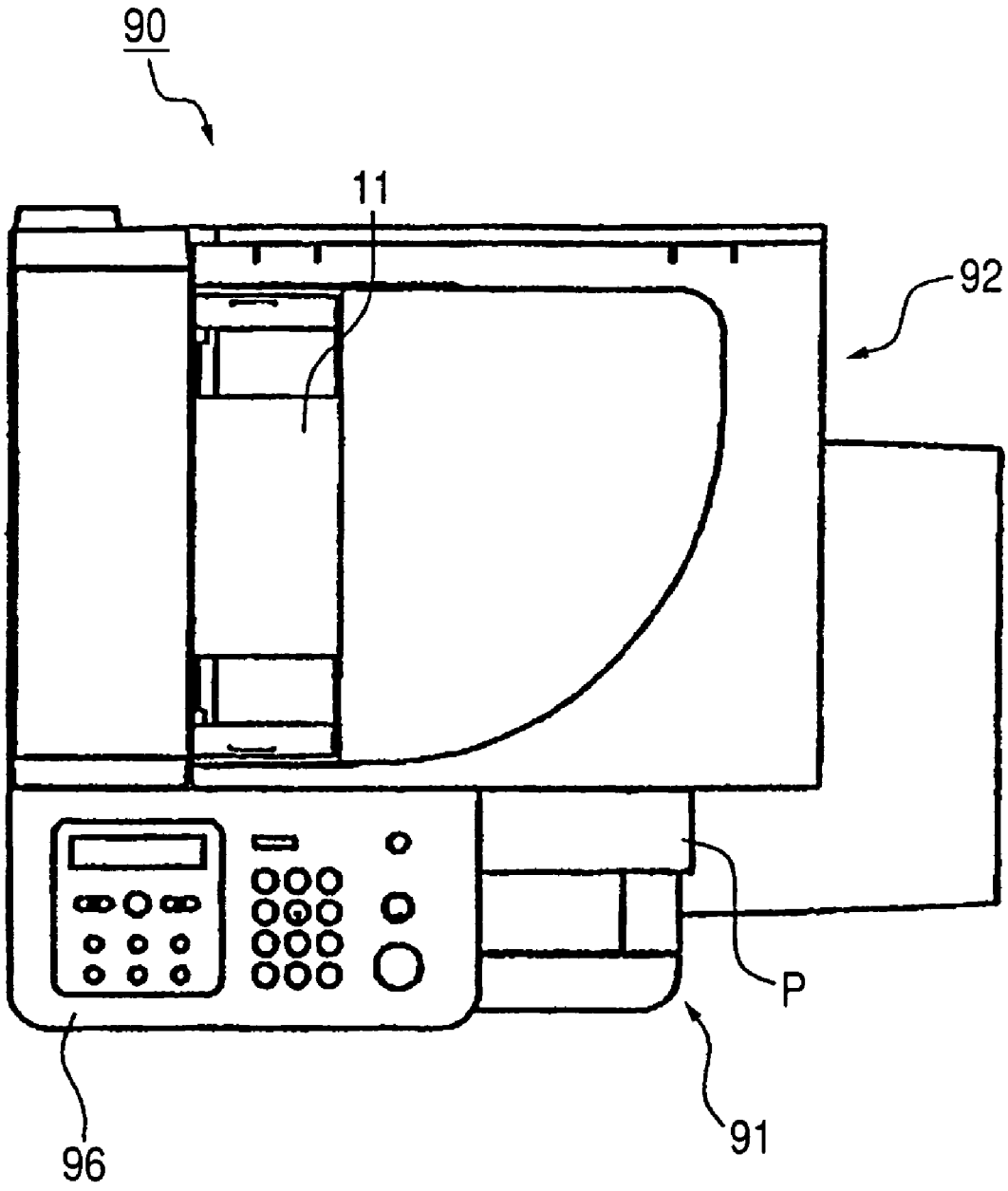
FIG. 2 is a plan view of the digital copying machine shown in FIG. 1.
Figure 3:
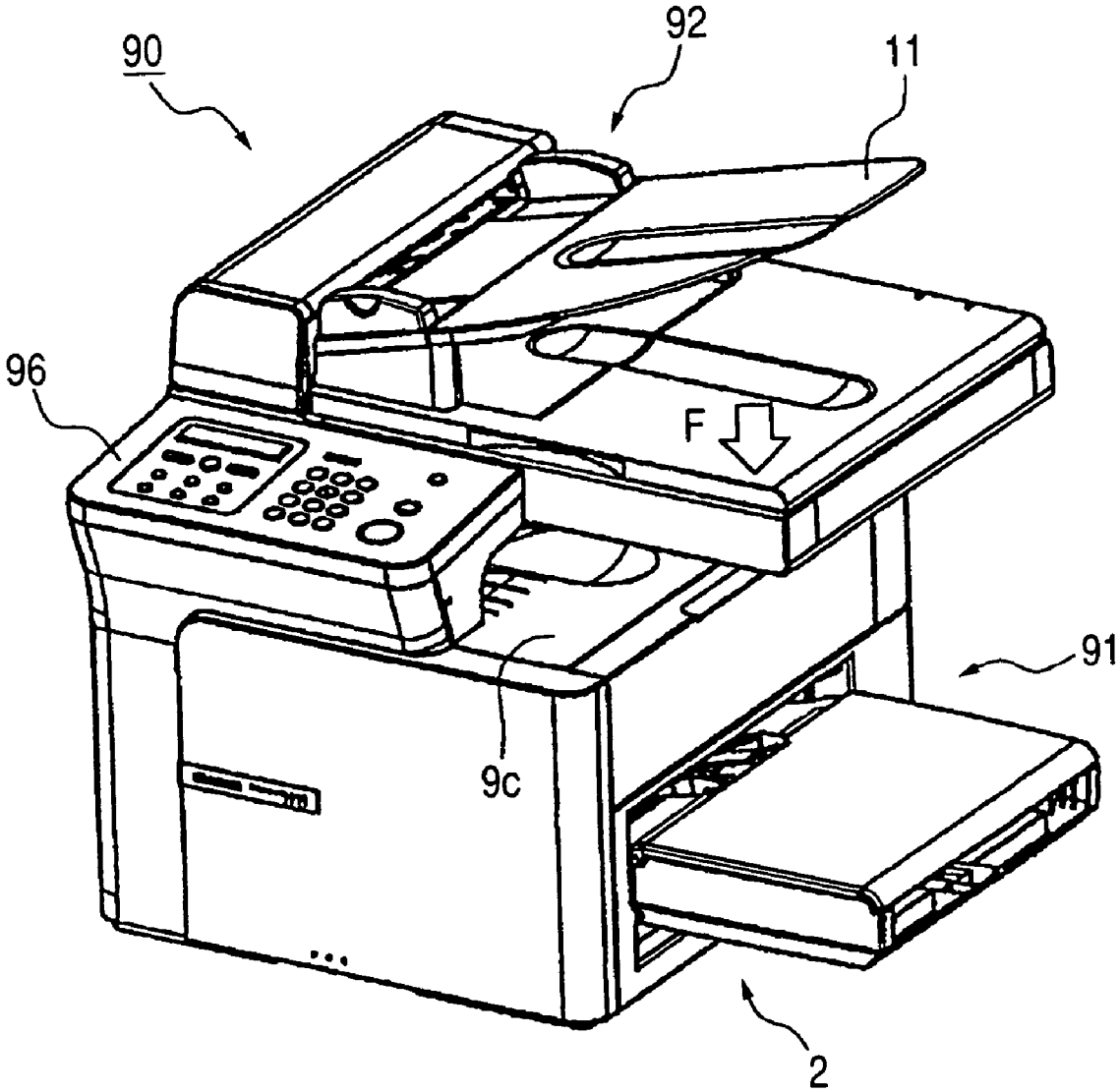
FIG. 3 is an external perspective view of the digital copying machine under a state where no recording paper is delivered and stacked on a recording paper delivery tray.
Figure 4:
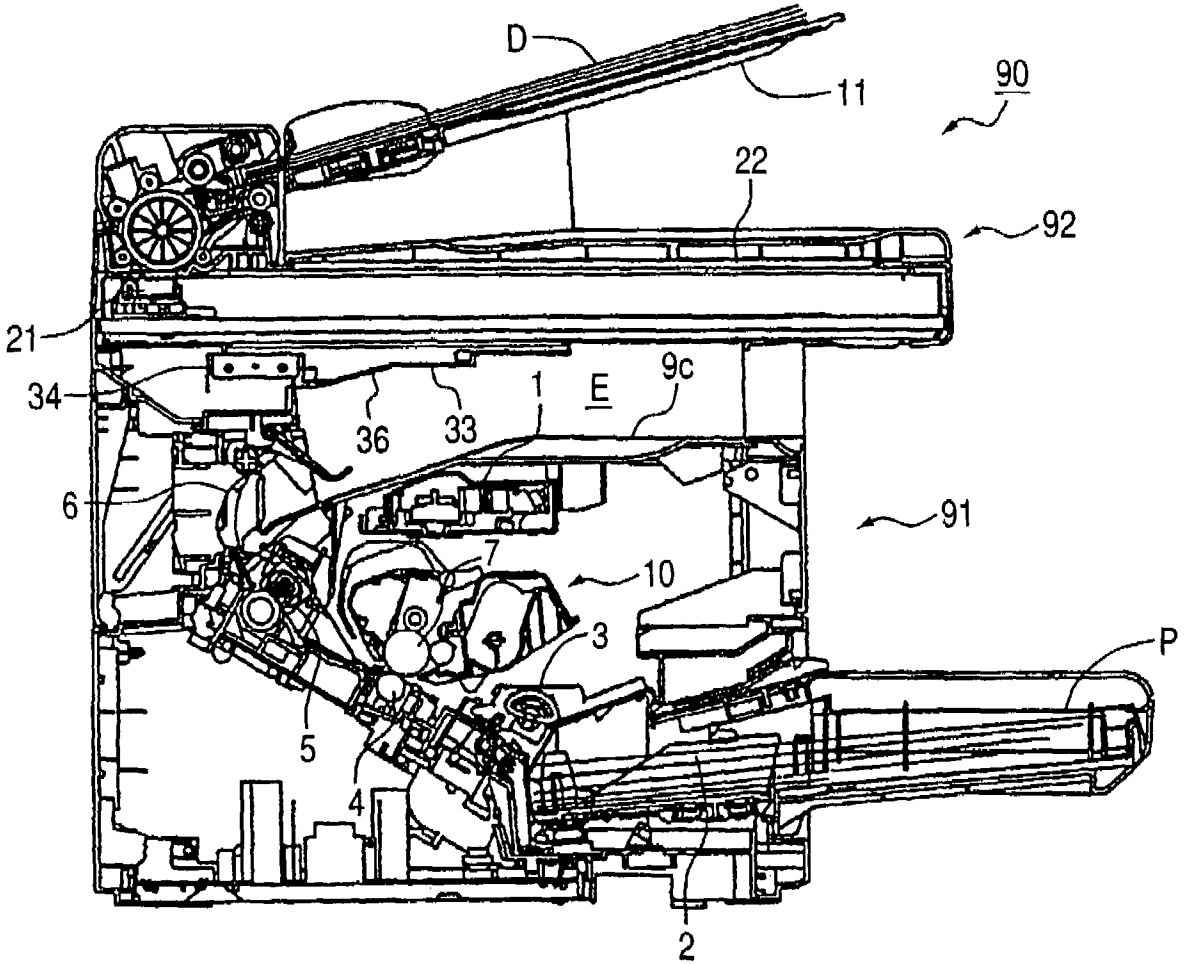
FIG. 4 is a cross-sectional view of the digital copying machine shown in FIG. 1 taken along a direction in which recording paper is transported.

FIG. 1 is an external perspective view of the digital copying machine that is an example of the image forming apparatus according to this embodiment of the present invention. FIG. 2 is a plan view of the digital copying machine shown in FIG. 1. FIG. 3 is an external perspective view of the digital copying machine under a state where no recording paper is delivered and stacked on a recording paper delivery tray. FIG. 4 is a cross-sectional view of the digital copying machine taken along a direction in which recording paper is transported.

A digital copying machine (hereinafter simply referred to as the copying machine) 90 that is an example of the image forming apparatus includes an image reading apparatus 92 that is an example of an image reading portion provided in an upper portion and an image recording apparatus 91 that is an example of an image recording portion provided in a lower portion. Also, when a copy mode is set, the copying machine 90 copies image information on an original D read with the image reading apparatus 92 onto recording paper in the image recording apparatus 91. On the other hand, when a printer mode is set, the copying machine 90 receives image data from a host personal computer (PC) and records it on the recording paper P using the image recording apparatus 91.

The image reading apparatus 92 is an apparatus that reads an image on a recording body such as a sheet-shaped original D or an opened book. When an automatic document feeder (ADF) mode is set, the image reading apparatus 92 successively transports multiple originals D placed on an original stand tray 11 one by one, reverses the surfaces of the originals in a sheet surface reverse path so that image forming surfaces of the originals face down, and successively reads images on the originals with reading means, such as a contact-type image sensor 21 which is held at a predetermined position. When a book mode is set, the image reading apparatus 92 reads an image on an original an opened book through movement of the image sensor 21, while setting the original or the opened book stationary on an original stand glass.

As shown in FIG. 4, the image recording apparatus 91 irradiates a photosensitive body drum 7 that is an image bearing body with laser light from an optical system 1 based on image information obtained by reading the original or book with the image reading apparatus 92 or image information transmitted from the outside, thereby forming an electrostatic latent image on the photosensitive body drum 7. Then, in an image recording portion constituted as a process cartridge 10, the electrostatic latent image formed on the photosensitive body drum 7 is developed with developer (toner), thereby obtaining a toner image. The photosensitive body drum 7, the process cartridge 10, and the like are each an example of image forming means.

Meanwhile, in synchronism with the formation of the toner image, recording paper P is supplied from a recording paper supplying portion 2 disposed in a bottom portion of the image recording portion 91 into the image recording apparatus 91 and is transported by a transport portion 3. A transferring device 4 transfers the toner image on the photosensitive body drum 7 onto the recording paper P. Then, a fixing device 5 fixes the toner image on the recording paper by pressurizing and heating the recording paper. Finally, the recording paper is delivered by a delivery roller 6 onto a delivery tray 9*c* that is an example of a sheet stacking portion. Secured between the delivery tray 9*c* and the image reading apparatus 92 is a space E required to stack the recording paper.

As shown in FIG. 2, the image reading apparatus 92 is disposed above the image recording apparatus 91 so as to be displaced toward the rear side. With this construction, in plan view, the delivered recording paper P is exposed to the outside on the front side of the image reading apparatus 92. The maximum size of recording paper on which the image recording apparatus 91 is capable of recording images, is set at 216 mm in width (letter size). Therefore, it is preferable that the image reading apparatus 92 is disposed at a position at which delivered recording paper having the generally used letter size or A4 size (whose width is 210 mm) are exposed to the outside.

Also, an operation portion 96 is disposed at a position at which the operation portion 96 is displaced toward the upstream side with respect to a direction in which the recording paper P is delivered, that is, to the left side in FIG. 2. Therefore, the delivered recording paper P is exposed to the outside above the image recording apparatus 91 and on the front side of the image reading apparatus 92.

The copying machine 90 of this embodiment has the construction described above, so that in plan view, the delivered recording paper P is partially exposed to the outside from the image reading apparatus 92 and the operation portion 96. As a result, it becomes possible for a user to take out the recording paper P with ease.

Also, the copying machine 90 of this embodiment has a construction in which the left end portion of the operation portion 96 is aligned with the left end portion of the image reading apparatus 92. As a result, there is provided an effect that a beautifully designed appearance is obtained in addition to the effect that it becomes easy to take out the delivered recording paper P.

Incidentally, with the construction described above of the copying machine 90 of this embodiment, although it becomes possible for the user to take out the recording paper P with ease, a right front portion of the image reading apparatus 92 protrudes into the air. This means it is necessary to provide a frame that supports the image reading apparatus 92 above the image recording apparatus 91 with a sufficient strength even if a load is placed on the right front portion of the image reading apparatus 92.

Figure 5:
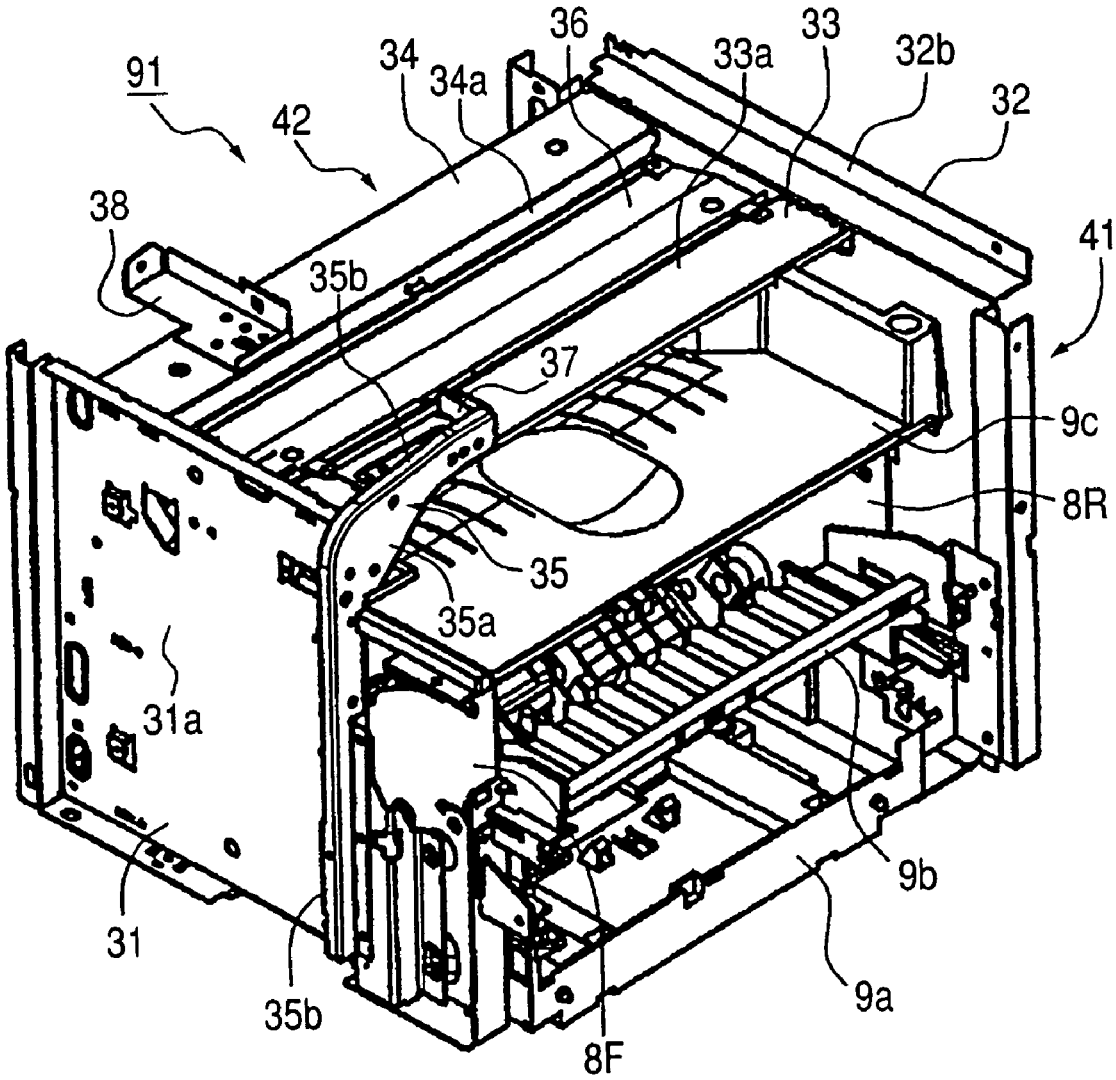
FIG. 5 is a perspective view of a first frame and a second frame that are respectively a recording portion frame and a supporting frame of the digital copying machine shown in FIG. 1 as viewed from above the right front side, from which a cover and the like of the copying machine are removed.
Figure 6:
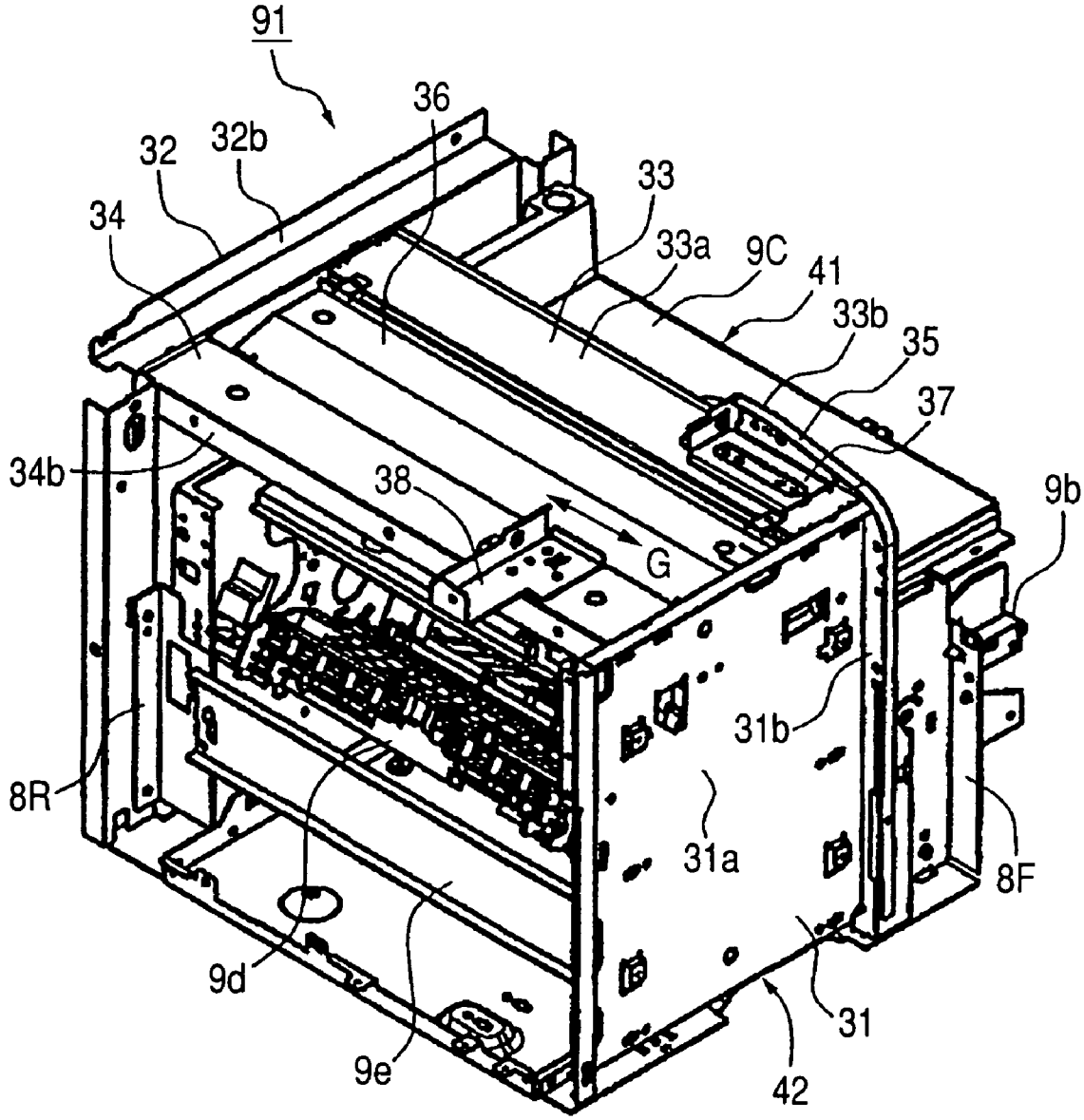
FIG. 6 is a perspective view of the first frame and the second frame as viewed from above the left front side, from which the cover and the like of the copying machine are removed.
Figure 7:
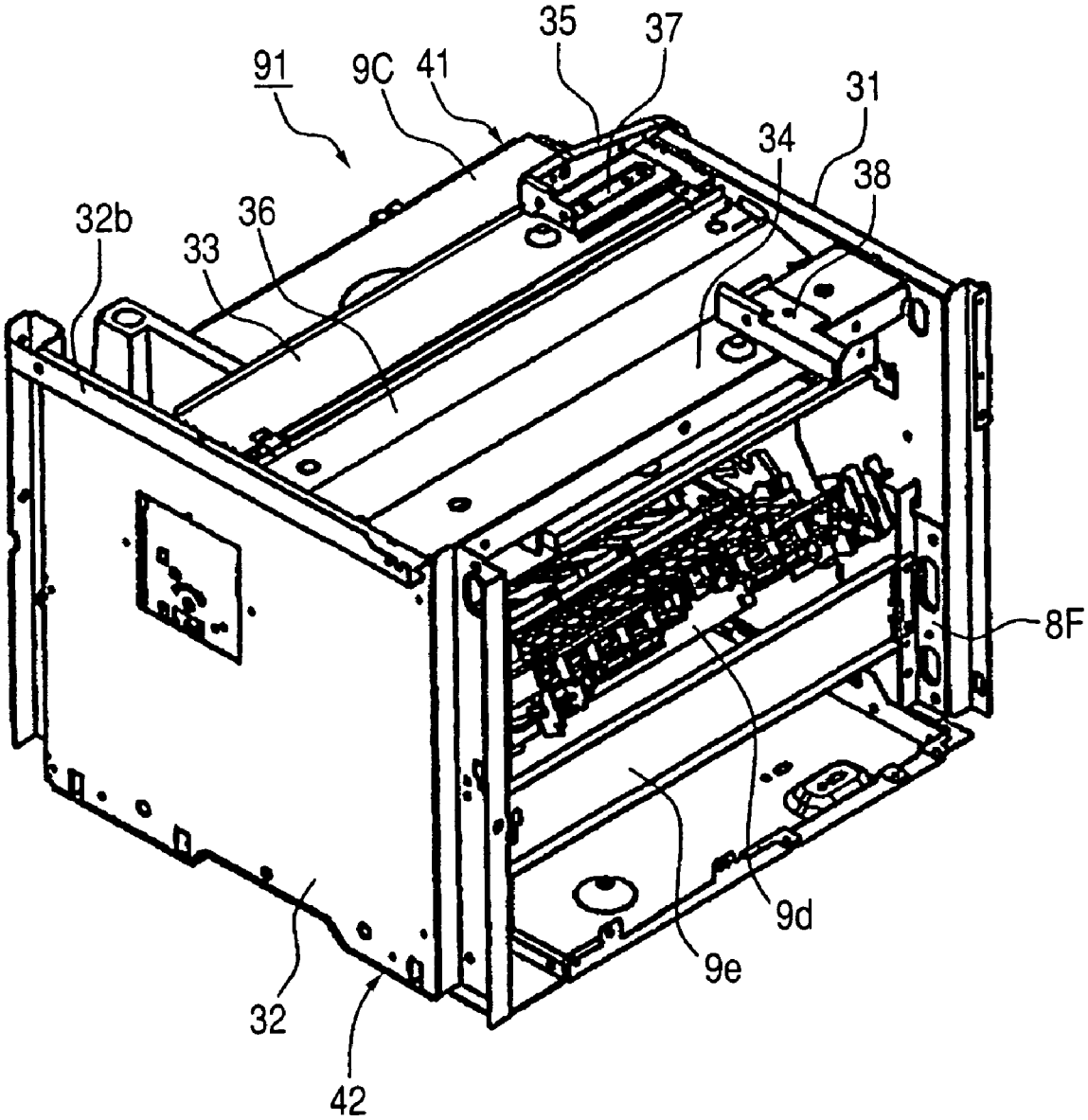
FIG. 7 is a perspective view of the first frame and the second frame as viewed from above the left rear side, from which the cover and the like of the copying machine are removed.

FIGS. 5, 6 and 7 are each a perspective view of the image recording apparatus 91 for illustrating a supporting frame for holding the image reading apparatus 92 of the digital copying machine according to the present invention. In these drawings, unnecessary components, such as a cover, are removed. FIG. 5 is a perspective view of the image recording apparatus 91 as viewed from above the right front side. FIG. 6 is a perspective view of the image recording apparatus 91 as viewed from above the left front side. FIG. 7 is a perspective view of the image recording apparatus 91 as viewed from above the left rear side.

In FIGS. 5, 6 and 7, an overall frame 40 of the copying machine 90 is formed by a first frame 41 that is an example of a recording portion frame, a second frame 42 that is an example of a supporting frame, a reinforcement stay 35 that is an example of a reinforcement member, and a reading portion frame 25 that is an example of a casing.

The first frame 41 supporting mainly the image recording apparatus 91 is formed by side plates 8F and 8R that are each made of a sheet metal and are coupled to each other with multiple stays 9*a*, 9*b*, 9*c*, 9*d*, 9*e*, and the like. Of these stays, the stay 9*c* serves as a delivery tray of the image recording apparatus 91 as well as a stay constituting the frame of the image recording apparatus 91.

The second frame 42 supporting the image reading apparatus 92 is formed by a front chassis 31 that is an example of a front member, a rear chassis 32 that is an example of a rear member, a right upper stay 33 and a left upper stay 34 that are each an example of a coupling member, and the like.

The front chassis 31 is made of a single sheet metal that is bent multiple times in order to increase its strength, and is integrated with the side plate 8F of the image recording apparatus 91 in an overlapping manner using not-shown bolts/nuts, rivets, or the like. With this construction, the strength of the front chassis 31 and the strength of the side plate 8F are mutually increased. Also, like the front chassis 31, the rear chassis 32 is made of a single sheet metal that is bent multiple times in order to increase its strength, and is integrated with the side plate 8R of the image recording apparatus 91 in an overlapping manner using not-shown bolts/nuts, rivets, or the like. With this construction, the strength of the rear chassis 32 and the strength of the side plate 8R are mutually increased.

With this construction, the first frame 41 and the second frame 42 are integrated with each other while reinforcing each other. As a result, it becomes possible to realize a reduction in weight and an increase in strength without increasing the plate thickness of the overall frame 40.

Also, the front chassis 31 and the rear chassis 32 are each formed to have a small thickness using a single sheet metal and are respectively integrated with the side plates 8F and 8R of the image recording apparatus 91. As a result, it becomes possible to form the second frame 42 with a size that is approximately the same as that of the image recording apparatus 91, which makes it possible to miniaturize the digital copying machine 90.

The right upper stay 33 and the left upper stay 34 couple the front chassis 31 and the rear chassis 32 to each other above the image recording apparatus 91 on the right side and the left side, respectively. Also, a sheet delivery upper portion guide 36 is provided between the right upper stay 33 and the left upper stay 34. The sheet delivery upper portion guide 36 guides the delivered recording paper so that it does not get caught on the right upper stay 33. The right upper stay 33, the left upper stay 34, and the sheet delivery upper portion guide 37 may be formed using a single sheet metal. In this case, however, the number of bent portions is increased and the shape becomes complicated, which leads to an increase in cost. Therefore, it is preferable that these components are formed as separated components. Also, the sheet delivery upper portion guide 36 does not need to have a strength as high as that of the stays, so that the sheet delivery upper portion guide 36 may be formed using a low-cost material in comparison with the right upper stay 33 and the left upper stay 34.

The right upper stay 33 and the left upper stay 34 are each formed by bending a sheet metal in a U shape or a Z shape, thereby achieving an increase in strength. Also, as shown in FIGS. 5 and 6, the strength of the left upper stay 34 is increased by forming bent portions 34*a* and 34*b* at sufficient heights. However, it is impossible to form such a bent portion at a sufficient height for the right upper stay 33 because the delivery tray 9*c* is raised in height closer to the right upper stay 33, so that the strength of the right upper stay 33 becomes lower than that of the left upper stay 34. Despite this, the right upper stay 33 is required to support the self weight of the image reading apparatus 92 protruding into the air on the right side and a load placed on the image reading apparatus 92. Accordingly, the right upper stay 33 is required to have a strength that is higher than that required for the left upper stay 34.

For this reason, in order to complement the poor strength of the right upper stay 33, the reinforcement stay 35 is attached to the right upper stay 33 and the front chassis 31. A principal plane 35*a* of the reinforcement stay 35 is attached to a vertically bent portion 33*b* that is an example of a bent piece formed perpendicular to a principal plane 33*a* of the right upper stay 33. The principal plane 35*a* of the reinforcement stay 35 is also attached to a vertically bent portion 31*b* that is an example of a bent piece formed perpendicular to a principal plane 31*a* of the front chassis 31. With this construction, the principal plane 35*a* becomes perpendicular to the principal plane 33*a* and the principal plane 31*a*. The right upper stay 33, the front chassis 31, and the reinforcement stay 35 are integrated with each other in this manner, so that the right upper stay 33 is reinforced.

Also, the reinforcement stay 35 extends up to a lower portion of the front chassis 31 and its strength is increased by combining and coupling a not-shown bent portion of the front chassis 31 and a not-shown bent portion of the reinforcement stay 35.

Further, in order to increase the strength of the reinforcement stay 35 itself, the reinforcement stay 35 is provided with a reinforcement piece 35*b* formed through ironing. This reinforcement piece 35*b* is bent perpendicular to the principal plane 35*a* and formed to extend parallel to the principal plane 31*a* of the front chassis 31 and successively parallel to the principal plane 33*a* of the right upper stay 33. That is, on the outer edge of the reinforcement stay 35, there is formed the reinforcement piece 35*b* that is an example of a bent piece that was bent on the right upper stay 33 side and the front chassis 31 side.

Auxiliary members 37 and 38 are each a member for attaching the image reading apparatus 92 to the second frame 42. The right upper auxiliary member 37 is attached to the right upper stay 33 and the left upper auxiliary member 38 is attached to the left upper stay 34. These auxiliary members 37 and 38 are capable of being adjusted in their attachment positions in the direction of arrow G (see FIG. 6) on the stays 33 and 34 to which they are respectively attached. With this construction, it becomes possible to perform adjustment in accordance with variations in depth dimension of the image reading apparatus 92 attached to the second frame 42.

Figure 8:
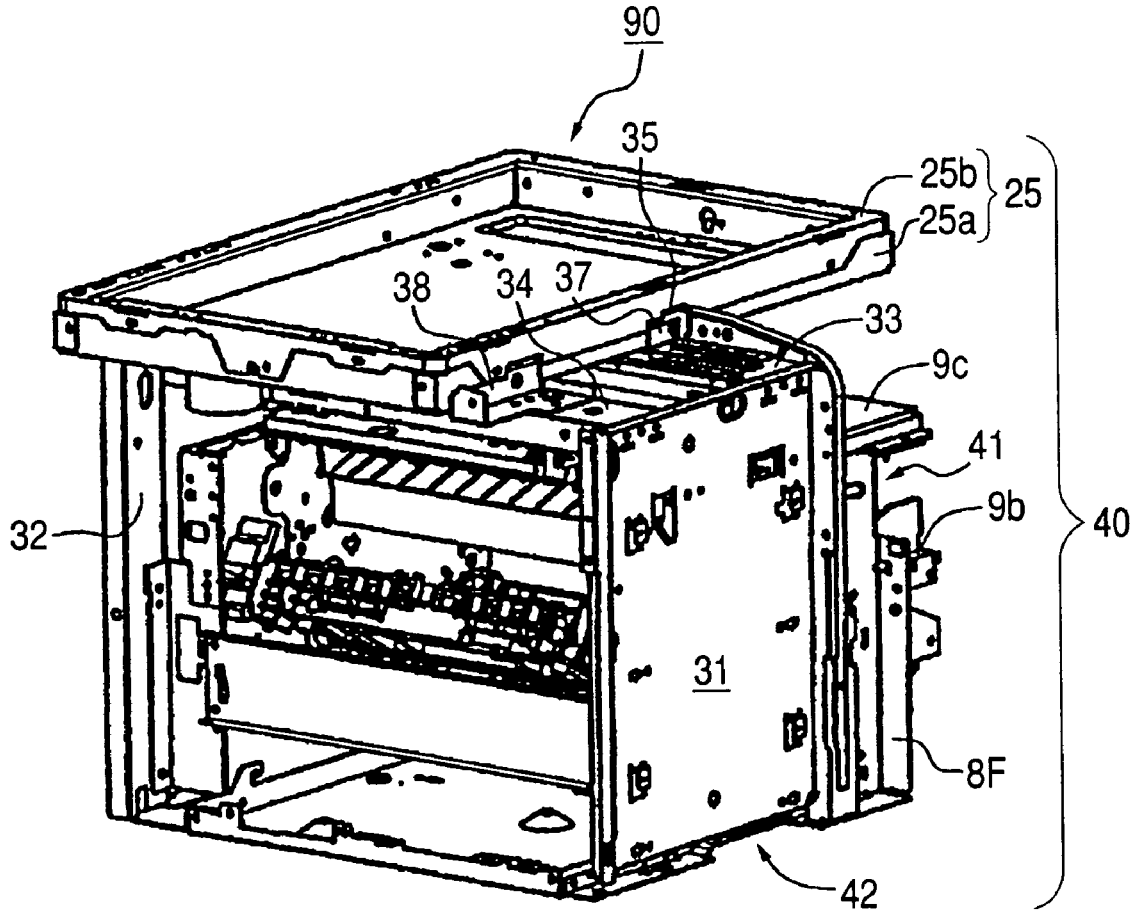
FIG. 8 is a perspective view of an overall frame of the copying machine under a state where the frames shown in FIG. 5 are provided with a casing of an image reading apparatus.
Figure 9:
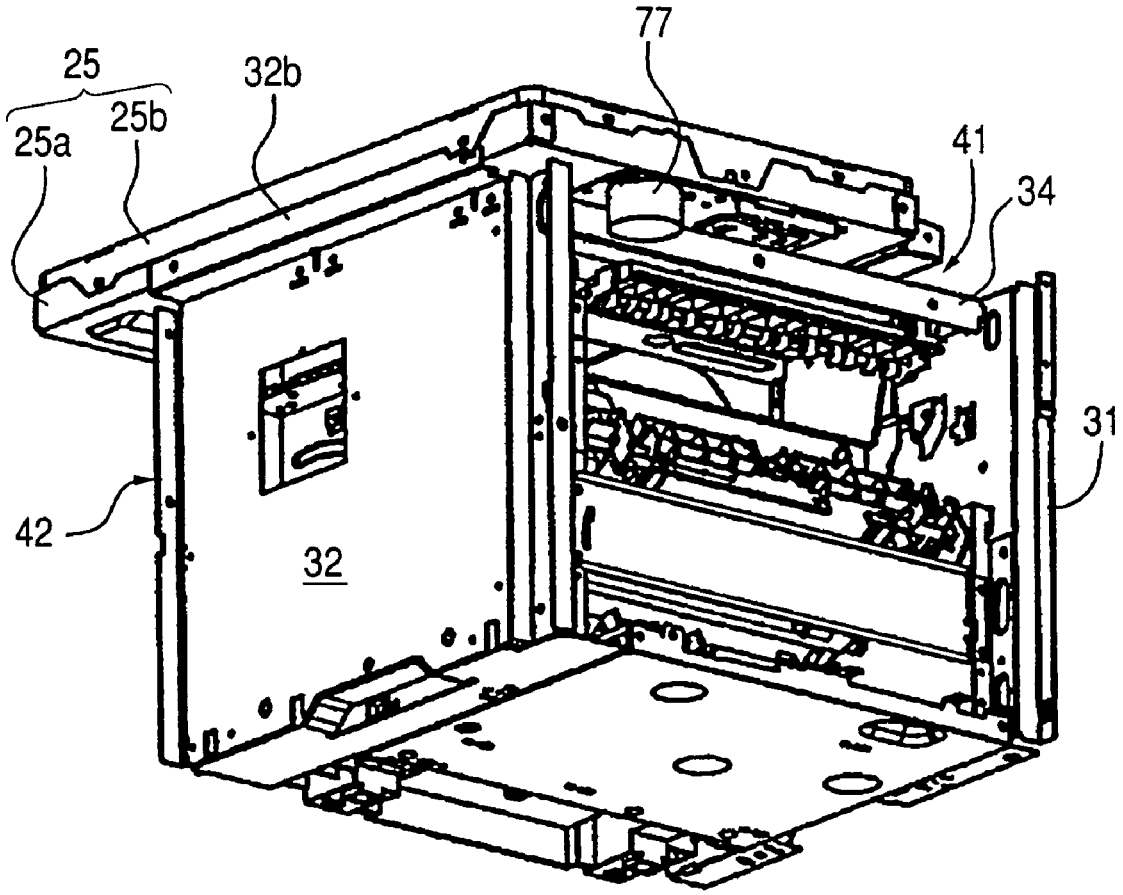
FIG. 9 is a perspective view of the overall frame of the copying machine shown in FIG. 8 as viewed from below the left rear side.

FIGS. 8 and 9 are each a perspective view showing a state where the reading portion frame 25 that is an example of the casing of the image reading apparatus 92 is attached to the aforementioned second frame 42 of the copying machine 90, with FIG. 8 being a view taken from above the left front side and FIG. 9 being a view taken from below the left rear side.

The reading portion frame 25 of the image reading apparatus 92 is formed by a base frame 25*a* and an upper frame 25*b*.

The base frame 25*a* is formed in a box shape by bending the four corners of a sheet metal and fixing the bent portions to each other. The upper frame 25*b* is formed in a box shape by bent portions obtained by successively bending the four corners of a sheet metal through ironing. Also, the box-shaped upper frame 25*b* is placed on the box-shaped base frame 25*a* like a lid so that the box-shaped frames 25*a* and 25*b* are fixed to each other in an overlapping manner, thereby obtaining a lightweight and high stiffness reading portion frame 25 of the image reading apparatus 92. With this construction, even when a load is placed on the protruding right front corner portion of the image reading apparatus 92, it is possible to prevent deformation of the image reading apparatus 92.

The reading portion frame 25 of the image reading apparatus 92 is fixed to the second frame 42 at four locations. The reading portion frame 25 is fixed to the left upper auxiliary member 38 on the front left side and is also fixed to the right upper auxiliary member 37 on the front right side, with the reinforcement stay 35 being sandwiched therebetween. The reading portion frame 25 is further fixed on the rear side to a bent portion 32*b* formed in an upper portion of the rear chassis 32 with bolts/nuts, rivets, or the like. That is, the reading portion frame 25 is fixed to the upper portion of the rear chassis 32 in the vicinity of the left and right ends.

It should be noted here that a motor 77 for driving the image sensor 21 of the image reading apparatus 92 protrudes from the undersurface of the reading portion frame 25. By providing this book motor 77 in the endmost portion of the reading portion frame 25 and disposing the left upper stay 34 at a position at which this stay 34 is inwardly displaced relative to the endmost portion so that it does not overlap the book motor 77 in a height direction, there is prevented a situation where the height of the image reading apparatus 92 is increased.

By constructing the copying machine in the manner described above, although the height of the space E between the image recording apparatus 91 and the image reading apparatus 92 is set at around 50 mm or less, for instance, and therefore the height of the image reading apparatus 92 is reduced, it becomes possible to take out the delivered recording paper P with ease. Also, even when a load placed on the right front corner portion of the image reading apparatus 92 protruding into the air, which is indicated by the arrow F in FIG. 3, is increased up to a level at which tilting of the apparatus as a while is narrowly avoided, deformation of the image reading apparatus 92 is suppressed. For reference, the maximum displacement amount is suppressed to around 3 mm or less and the deformation amount after removing the load is removed is suppressed to around 0.1 mm or less, for instance.

Figure 10:
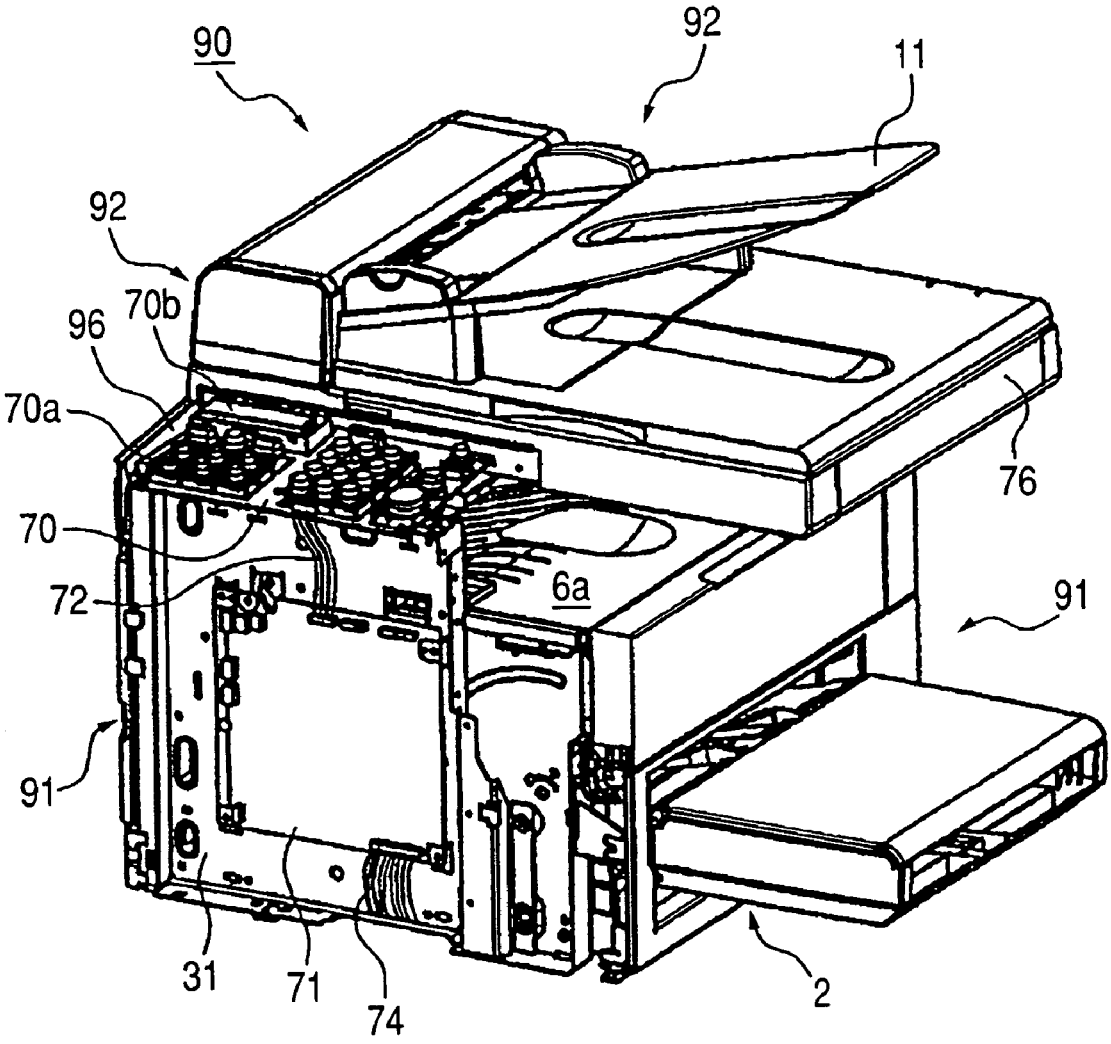
FIG. 10 is an external perspective view of the digital copying machine from which a front cover and an operation portion cover of an apparatus main body are detached.
Figure 11:
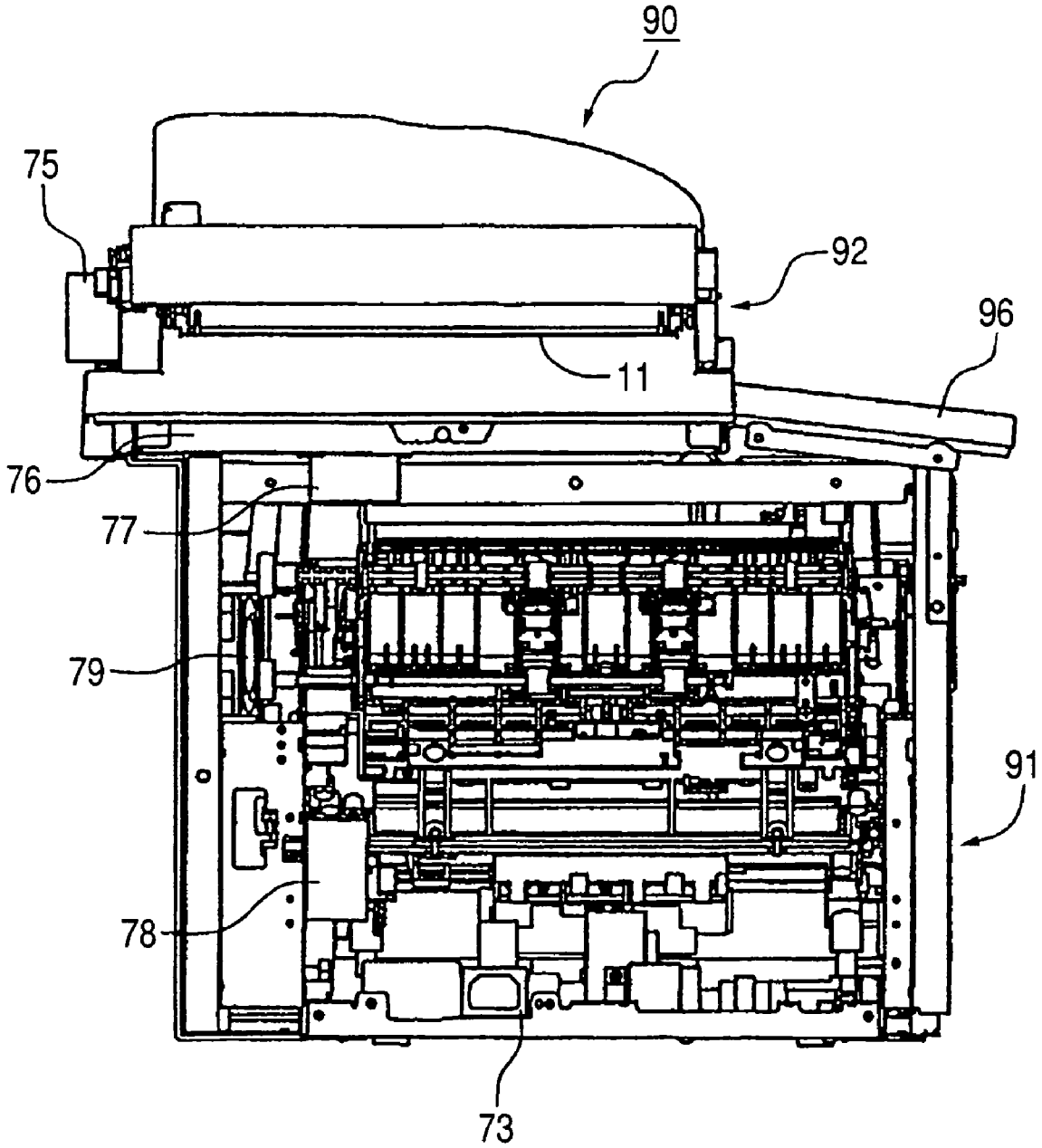
FIG. 11 is a left side view of the digital copying machine under a state where a left cover of the apparatus main body is detached.
Figure 12:
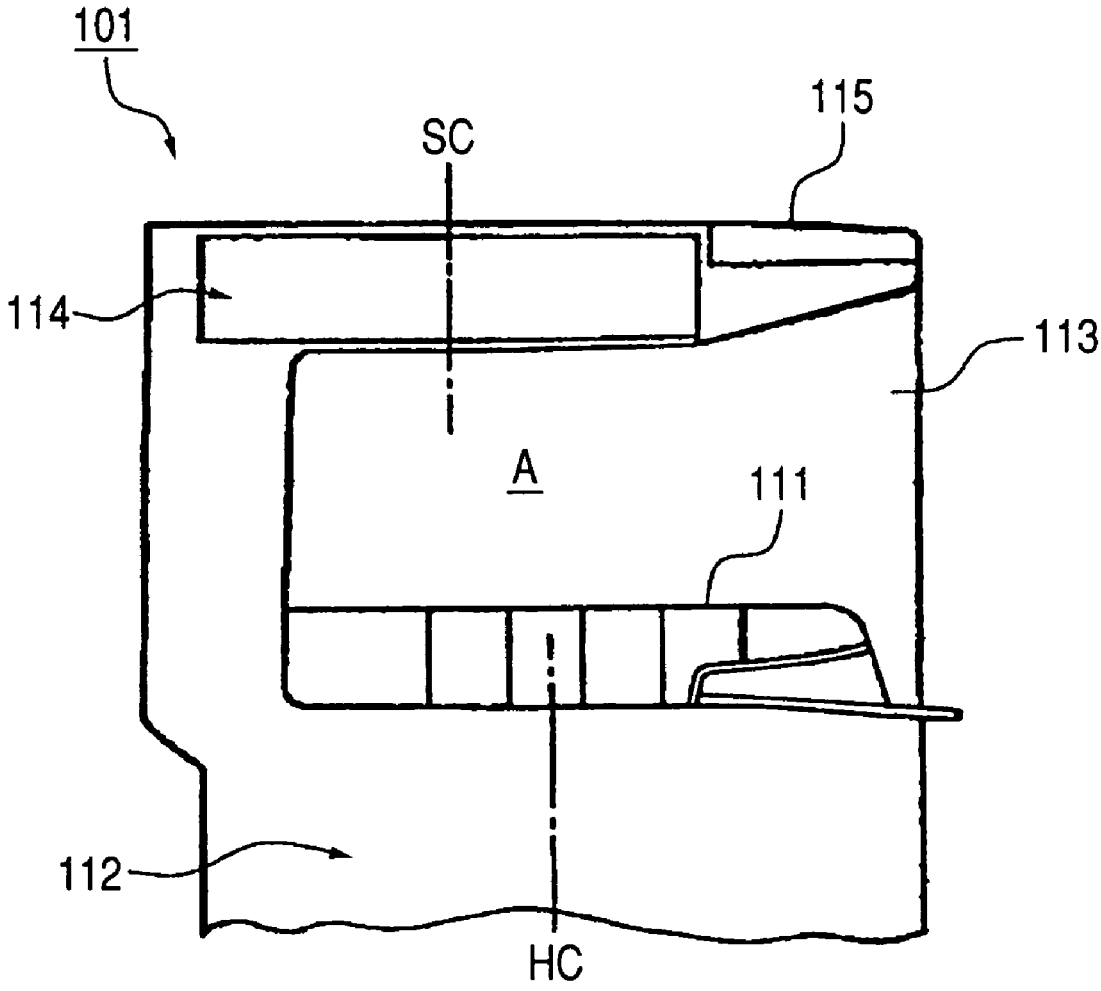
FIG. 12 is a schematic view of an image forming apparatus of a first conventional example.
Figure 13:
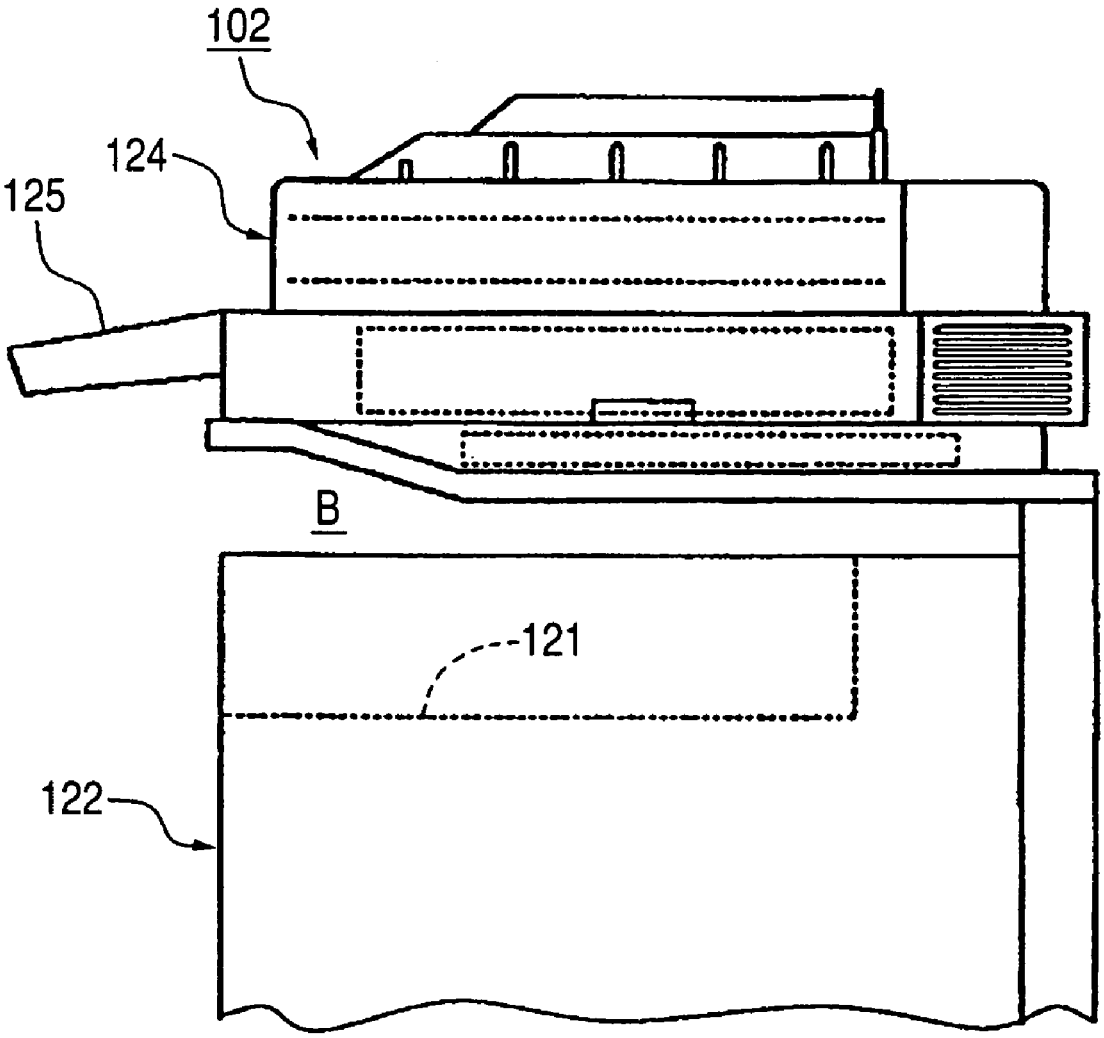
FIG. 13 is a schematic view of an image forming apparatus of a second conventional example.

FIG. 10 is an external perspective view of the copying machine 90 under a state where a front cover and an operation portion cover of the apparatus main body are detached. FIG. 11 is a left side view of the copying machine under a state where a left cover of the copying machine is detached.

Immediately below the operation portion 96, an operation portion circuit board 70 that is an example of a first circuit board equipped with a not-shown operation command input circuit is provided approximately parallel to the top surface of the operation portion 96. The operation portion circuit board 70 is also provided with keys 70*a* for inputting operation commands, an LCD panel 70*b* for displaying operation states, and the like. On the front side of the image recording apparatus 91, a main body control circuit board 71 that is an example of a second circuit board equipped with a not-shown main body control circuit and image information processing circuit is fixed to the front chassis 31. The operation portion circuit board 70 is electrically connected to the main body control circuit board 71 in a substantially linear manner by electric wire cables 72 that are an example of connecting means.

In a bottom portion inside the image recording apparatus 91, there is disposed a power supply circuit board 73 that is an example of a third circuit board equipped with a not-shown power supply input portion and control circuit portion related to image formation. Like the operation portion circuit board 70, the power supply circuit board 73 is electrically connected to the main body control circuit board 71 in a substantially linear manner by electric wire cables 74 that are an example of connecting means.

FIG. 11 is a left side view of the copying machine under a state where the left cover of the copying machine is detached. An automatic document feeder motor (ADF motor) 75 that is an example of an image reading motor for transporting the original D in the ADF mode of the image reading apparatus is arranged on the rear side of the apparatus main body as shown in FIG. 11, and drives each roller of the image reading apparatus 92 using a not-shown driving force transmission means.

The book motor 77 for reading image information on the original stand glass 22 in the book mode is arranged on the apparatus rear side in the vicinity of the left end of the bottom surface of a reading unit 76 and moves the image sensor 21 in the reading unit 76 using a driving force transmission means (not shown).

A recording motor 78 that is an example of an image forming motor for transporting the recording paper P in the image recording apparatus 91 and driving the image recording apparatus 91 is arranged on the rear side of the image recording apparatus 91 and drives each roller, the process cartridge 10, and the like of the image recording apparatus 91 using a driving force transmission means (not shown).

A fan motor 79 that is an example of a cooling motor for cooling the optical system 1 (in particular, a scanner motor 1*d*) is also arranged on the rear side of the image recording apparatus 91 and is covered with a not-shown louver member provided at the rear of the apparatus as a guard. The fan motor 79 is rotated by electric power supplied by the power supply circuit board through an electric wire cable (not shown).

With this construction, each motor that is the source of a driving force for the apparatus main body is disposed on the rear side of the apparatus and is at a position distant from the circuits and electric wire cables that electrically connect multiple electric circuit boards on the apparatus front side. As a result, it becomes possible to minimize the adverse effect of electric noise from each motor on the circuits and the electric wire cables. Also, each motor is disposed on the side opposite to the front side on which the operation portion 96 to be operated by the user is arranged, so that it becomes possible to lower the level of noise generated by the motors and perceived by the user on the apparatus front side.

What is claimed is:

1. An image forming apparatus comprising:

an image recording device that records an image on a sheet;

a sheet stacking portion which is provided above said image recording device and on which the sheet delivered from said image recording device is stacked;

an image reader that is provided above said sheet stacking portion and reads an image on an original; and an operation portion which adjoins said image reader and by which a user performs an input operation, wherein said operation portion is disposed on a front side of said image reader and on an upstream side with respect to a sheet delivery direction in which the sheet is delivered to said sheet stacking portion, and wherein a part of the sheet stacked on said sheet stacking portion is exposed on the front side of said image reader as viewed from a direction in which the user performs the input operation by said operation portion, and on a downstream side of said operation portion in the sheet delivery direction.

2. An image forming apparatus according to claim 1, wherein the exposed part of the sheet stacked on said sheet stacking portion is a corner of the sheet.

3. An image forming apparatus according to claim 2, wherein the corner of the sheet is continuous from a leading edge of the sheet in the sheet delivery direction to a side edge of the sheet.

4. An image forming apparatus according to claim 1, wherein said image reader is disposed so as to be displaced toward a rear side so that the part of the sheet delivered from said image recording device onto said sheet stacking portion is exposed on the front side of said image reader.

5. An image forming apparatus according to claim 1, wherein a rear surface position of a casing of said image reader is disposed so as to protrud rearward of a rear surface position of a casing of said image recording device.

6. An image forming apparatus according to claim 1, wherein said operation portion is connected to both of said image reader and said image recording device.

7. An image forming apparatus according to claim 1, wherein said image reader includes an original placing stand on which the original is placed, and an original delivery stand which is disposed below said original placing stand and on which a delivered original is stacked.

8. An image forming apparatus according to claim 7, wherein an original delivery direction along which the original is delivered onto said original delivery stand is the same as the sheet delivery direction along which the sheet is delivered onto said sheet stacking portion.

* * * * *